United States Patent [19]

Trinkl et al.

[11] Patent Number: 4,467,858

[45] Date of Patent: Aug. 28, 1984

[54] BLIND FEEDER SLEEVES

[75] Inventors: Gerd Trinkl; Helmut Schopp, both of Borken, Fed. Rep. of Germany

[73] Assignee: Foseco International Limited, Birmingham, England

[21] Appl. No.: 362,107

[22] Filed: Mar. 26, 1982

[30] Foreign Application Priority Data

Apr. 10, 1981 [DE] Fed. Rep. of Germany ... 8110973[U]

[51] Int. Cl.[3] ..... B22C 9/08

[52] U.S. Cl. ..... 164/360; 164/359

[58] Field of Search ..... 164/359, 360, 363

[56] References Cited

U.S. PATENT DOCUMENTS 2,205,327 6/1940 Williams ..... 22/129
3,513,904 5/1970 Lane ..... 164/360

FOREIGN PATENT DOCUMENTS 1940880 2/1971 Fed. Rep. of Germany ..... 164/359
2907301 9/1980 Fed. Rep. of Germany ..... 164/360
2917520 11/1980 Fed. Rep. of Germany ..... 164/360
45-23229 8/1970 Japan .
53-69577 6/1978 Japan .
978644 of 1977 United Kingdom .

*Primary Examiner*—Kuang Y. Lin
*Assistant Examiner*—Richard K. Seidel
*Attorney, Agent, or Firm*—Cushman, Darby & Cushman

[57] ABSTRACT

A blind feeder sleeve for use in the casting of metals comprises a sleeve body and a cover having a Williams core, and optionally an opening for ventilation, the Williams core being formed integrally with the feeder sleeve and comprising a rib extending across the inner surface of the cover and projecting downwardly from that surface in a wedge like shape. Preferably the rib is formed integrally with the inner surface of the cover at each end of the rib, and when the feeder sleeve is circular in cross-section the rib preferably extends across a diameter of the sleeve.

16 Claims, 8 Drawing Figures

Figure 1:
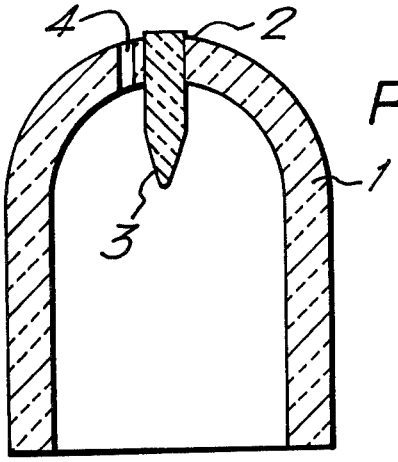

FIG.7.
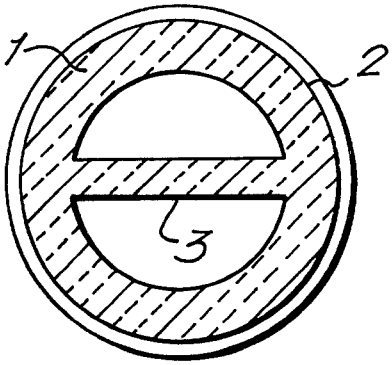
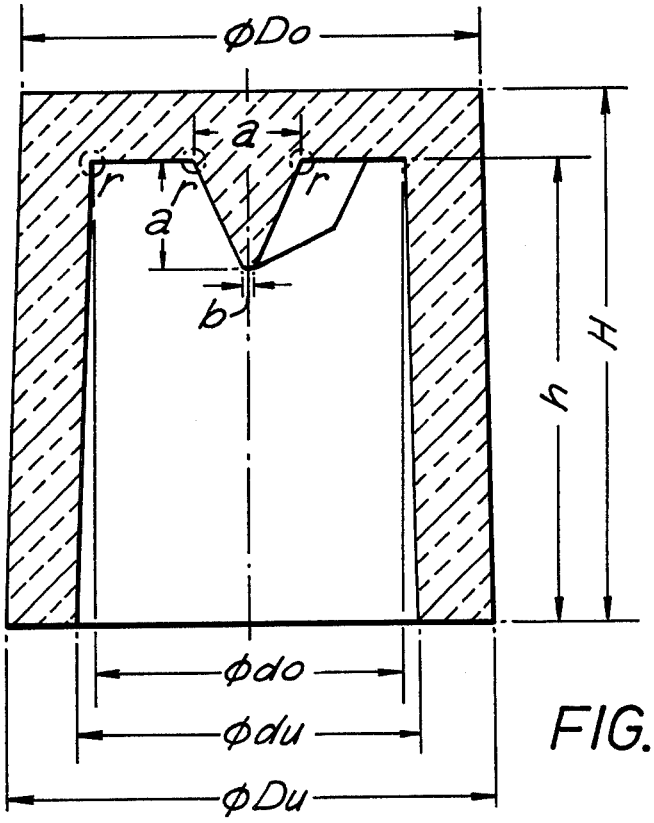
FIG.8.

BLIND FEEDER SLEEVES

This invention concerns blind feeder sleeves for use in the casting of metals.

During solidification metals shrink under-going a reduction of their volume. As a result, it is usually necessary to employ feeder heads located above or at the side of castings in order to compensate for the shrinkage of the castings, and it is common practice to surround a feeder head with an exothermic or thermally insulating feeder sleeve in order to retain the feeder head in the molten state for as long as possible, and thereby to improve the feeding effect and to enable the feeder head volume to be reduced to a minimum.

Feeder sleeves may be classified according to two types, namely open feeder sleeves the top of which are open to the atmosphere and blind feeder sleeves which are closed at the top and are bedded in a sand mould.

The present invention is concerned with the latter type of blind feeder sleeves.

A blind feeder sleeve normally has a round or oval cross-section and has a domed or a flat cover which is formed integrally with the sleeve body and is of the same composition as that of the sleeve. When using a blind feeder sleeve it is normal practice to locate a Williams core at the inner surface of the cover to improve and stabilise the feeding effect. A Williams core is a gas-permeable core. Williams cores commonly have sharp, pointed ends, e.g. in the shape of cones and pyramids. Such cores may be formed integrally with the feeder sleeves or they may be produced separately and then fixed to the inside of the sleeves at their upper end. Williams cores are normally made of sand, or of a heat-insulating or exothermic material. The feeding effect is improved due to atmospheric pressure exerted on the feeder head by means of the Williams core. Williams cores as they are known in practice are shown in the drawings of FIGS. 1 and 2.

Figure 2:
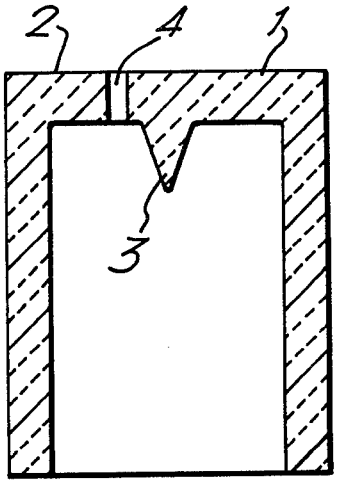

FIGS. 1 and 2 are vertical sections of typical blind feeder sleeves with Williams cores.

FIG. 1 shows a domed blind feeder sleeve 1 with an opening which is formed in the cover 2 in which a separate Williams core 3 is inserted. An opening 4 for venting is formed next to the opening for the Williams core.

FIG. 2 shows a blind feeder sleeve with a flat cover 2 wherein a Willimas core 3 is formed integrally with the body of the sleeve and having an opening 4 for venting.

Figure 3:
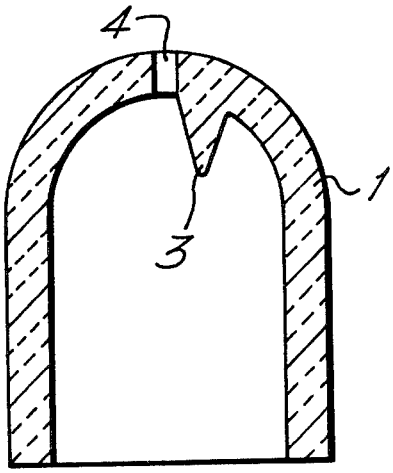

As is shown in FIGS. 1 and 2 the Williams core is normally formed in the centre of the inside of the cover 2 of the sleeve. As is shown in FIG. 3 another type of feeder sleeve 1 is also used wherein an opening for venting 4 is positioned in the centre of the cover and a Williams core is provided offset from the centre. Although Williams cores may be formed separately from the body of the sleeve as is shown in FIG. 1 this causes several problems. For example their preservation and storage is troublesome: work is necessary to fit them into the sleeve. In addition there is always the possibility of errors being made during fitting due to the size of the Williams core not always being suitable for the size of feeder sleeve. Because it is difficult to produce Williams cores proportional to each size of feeder sleeve a Williams core of a particular size may have to be used with sleeves of varying sizes. It is therefore preferred that the Williams core is formed integrally with a feeder sleeve as is shown in FIGS. 2 and 3.

The length of a Williams core may be for example between 1/10 and ½ of the height of the cavity of the feeder sleeve, the actual size of the Williams core becoming larger the larger the size of the sleeve. As stated previously, the Williams core usually has a conical or a pyramidal shape and extends vertically downwards from the domed or flat cover to a point. The lower end of such a Williams core tends to break off because of its shape, and when a Williams core whose lower end has been broken off is used satisfactory feeding may not be achieved and defects may be created in the cast body. It is therefore preferred to enlarge the angle of the lower end of the Williams core in order to reduce the possibility of the lower end of the Williams core breaking off, but because the angle at the point of the Williams core is thus made more obtuse the effect of the Williams core is reduced. Recently, a blind feeder sleeve having an improved feeding effect has been developed in which a Williams core showing improved resistance to breaking off is formed integrally with the sleeve.

In particular, a blind feeder sleeve has been produced with a Williams core and a hole for ventilation in the cover, in which the Williams core is formed integrally with the sleeve and in which the Williams core consists of a projection extending in the direction of the central axis of the sleeve and vertically downwards from the inner shoulder of the sleeve.

Figure 4:
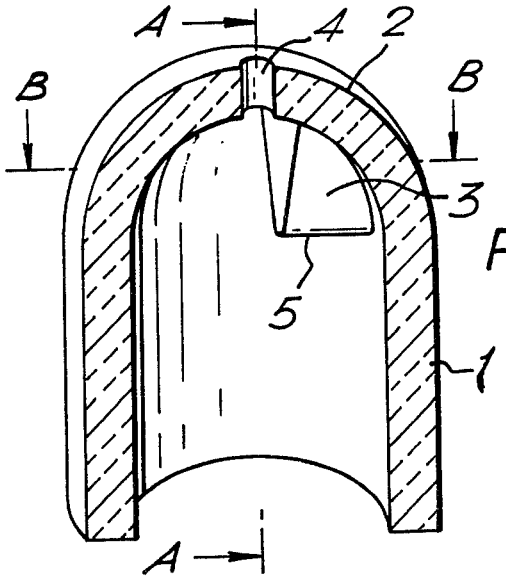

Such a feeder sleeve is shown in FIG. 4 wherein 1 represents the feeder sleeve, 2 the cover, 3 the Williams core and 4 a ventilation opening. The lower edge 5 of the Williams core is sharply linear.

Figure 6:
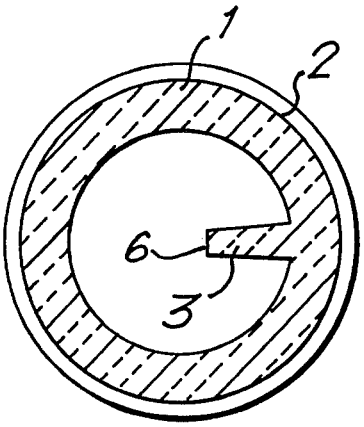
Figure 5:
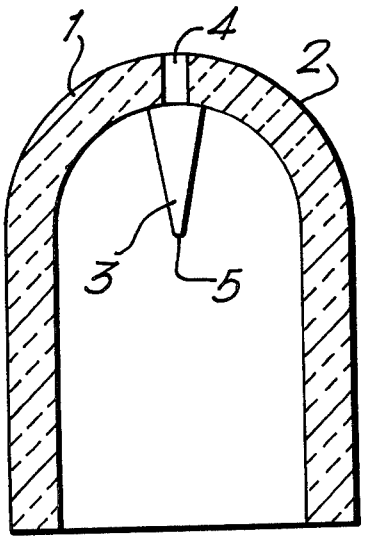

FIG. 5 shows a vertical section through the feeder sleeve of FIG. 4 taken along line A—A and FIG. 6 shows a cross-section through the same feeder sleeve taken along line B—B of FIG. 4. As may be seen particularly from FIG. 6, the Williams core 3 extends from the outer edge of the cover 2 towards the centre of the cover.

This type of Williams core however has the disadvantage that during the manufacture of the feeder sleeve by the use of a forming templet or a forming tool the Williams core breaks off readily when the feeder sleeve is removed from the templet. Furthermore the effectiveness of such a Williams core with regard to its feeding function is not ideal.

According to the invention there is provided a blind feeder sleeve comprising a sleeve body and a cover and having a Williams (i.e., gas-permeable) core and optionally an opening for ventilation, the Williams core being formed integrally with the feeder sleeve, characterised in that the Williams core comprises a rib extending across the inner surface of the cover and projecting downwardly from that surface in a wedge like shape.

The feeder sleeve body may be cylindrical or conical and of circular or oval cross-section, and the cover may be for example flat or domed.

The rib is preferably formed integrally with the inner surface of the sleeve body at each end of the rib and when the sleeve is of circular cross-section the rib preferably extends across a diameter of the sleeve.

The feeder sleeve and Williams core may be formed from heat-insulating, exothermic or heat-insulating and exothermic material.

The invention is illustrated by way of example with reference to the drawings in which FIGS. 7 and 8 are horizontal and vertical cross-sections respectively through a feeder sleeve according to the invention.

In FIG. 7, 1 represents the feeder sleeve itself, 2 the surface of the cover and 3 the Williams (i.e., gas-permeable) core.

The Williams core 3 is formed integrally with the inner surface of the cover 2 and with the inner surface of the sleeve body adjacent to the cover. The Williams core 3 extends across a diameter of the sleeve 1 over the full inner surface of the cover 2. Because of the particular form of the Williams core according to the invention the following advantages are achieved.

In the case of a normal Williams core there is a tendency for molten metal to penetrate and solidify near to the pointed end of the core thus making the core impermeable and preventing it from fulfilling its function. There is also the same tendency with a wedge shaped core which extends only to the centre of the cover but in the case of the sleeve of the invention, because the Williams core extends over the complete surface of the cover this tendency is reduced. Since the Williams core of the invention has a relatively large surface area the danger of a complete blockage of the permeable Williams core by penetration and solidification of metal is significantly reduced and direct contact between the liquid metal contained in the feeder sleeve and the atmosphere may be maintained thus ensuring a uniform and effective supply of liquid metal to the solidifying casting and preventing the formation of cavities due to shrinkage of the solidifying metal. If the direct connection between the liquid metal in the sleeve and the atmosphere through the Williams core is interrupted because of a blockage of the pores of the Williams core as a result of penetrated liquid metal which has solidified in the core then a satisfactory feeding effect will not be achieved.

A further advantage is achieved in the production of the feeder sleeves. When a conical Williams core is used or a wedge shaped Williams core of the type which extends to the centre of the cover, there is a significant danger that during the removal of the feeder sleeve from the moulding templet the conical or short Williams core breaks off as a result of compressive and tensile strains. When the Williams core of the invention is formed as a wedge shaped rib connected with the cover across the whole inner surface of the cover and also connected at its ends to opposite sides of the sleeve body whereby the end surfaces of the Williams core are protected, the danger of the core breaking off is considerably reduced. The production of a feeder sleeve with such a Williams core is therefore made significantly easier. When, after forming the feeder sleeve, the green sleeve is removed from the templet, then even though the green sleeve has only very low inherent strength, as a result of the integral formation with the Williams core which is in contact with the inner surface of the cover and with the opposite walls of the sleeve body a significantly stronger feeder sleeve is obtained and at the same time the Williams core is protected. A third advantage is that because of the greater surface area of the core a significantly stronger connection is created between the molten metal in the feeder and the atmosphere. In this connection it should be noted that even if the whole feeder sleeve is made from a porous material which is permeable with regard to air a connection between the atmosphere and the liquid melt contained in the feeder sleeve is not normally achieved because the metal solidifies on the walls of the feeder and blocks off the pores. Contact with the atmosphere is maintained without difficulty using the Williams core according to the invention because the core is maintained in direct contact with the molten metal.

The feeder sleeve according to the invention may possess an opening for ventilation in its cover. This ventilation opening serves to release to the atmosphere gses resulting from reaction between the molten metal and the mould material during the casting of the metal and to allow the escape of air which is contained in the mould and which is displaced by the incoming metal melt.

A further advantage of the feeder sleeve according to the invention is that the Williams core, because of its greater stability, no longer breaks off when the feeder sleeve is inserted into a mould, for example under the stresses of jolt-squeezing. In order to counteract compressive stresses during the production of the mould the hollow feeder sleeves are located over supporting pegs in which the grooves, which are provided to accommodate the Williams core, are somewhat larger than the Williams core itself.

Table 1 below shows by way of example suitable sizes for the dimensions a, b and r of the Williams core 3 illustrated schematically in FIG. 8 and Table 2 shows typical dimensions for the corresponding feeder sleeves 2.

TABLE 1

| | Williams-Core Dimensions (mm) | | |
|---|---|---|---|
| Type | a | b | r |
| 1 | 14 | 2 | 3 |
| 2 | 14 | 2 | 3 |
| 3 | 16 | 2 | 3 |
| 4 | 18 | 2 | 3 |
| 5 | 20 | 3 | 4 |
| 6 | 22 | 3 | 4 |
| 7 | 26 | 3 | 5 |
| 8 | 30 | 3 | 5 |

TABLE 2

| | Dimensions (mm) | | | | | | |
|---|---|---|---|---|---|---|---|
| Type | Inner diameter at bottom (du) | Outer diameter at bottom (do) | Inner diameter at top (Du) | Outer diameter at top (Do) | Inside height (h) | Outside height (H) | Volume ($dm^3$) |
| 1 | 41.5 | 62.5 | 35.5 | 59.0 | 64.0 | 73.5 | 0.07 |
| 2 | 43.0 | 63.0 | 36.0 | 59.0 | 85.5 | 97.5 | 0.10 |
| 3 | 52.0 | 73.5 | 48.0 | 69.5 | 70.5 | 81.5 | 0.13 |
| 4 | 58.5 | 80.5 | 52.5 | 76.5 | 77.5 | 91.5 | 0.18 |
| 5 | 70.5 | 94.0 | 65.5 | 89.5 | 88.0 | 100.5 | 0.30 |
| 6 | 80.0 | 103.0 | 71.5 | 99.5 | 98.0 | 111.0 | 0.42 |
| 7 | 98.0 | 128.0 | 91.5 | 119.0 | 120.5 | 135.0 | 0.82 |
| 8 | 119.0 | 154.5 | 112.0 | 148.0 | 131.5 | 150.5 | 1.32 |

We claim:

1. A blind feeder sleeve comprising a sleeve body and a cover and having a gas-permeable core, the gas-permeable core being formed integrally with the feeder sleeve, and wherein the gas-permeable core consists of a rib extending directly across the inner surface of the cover and projecting downwardly from that surface in a wedge like shape.

2. A blind feeder sleeve according to claim 1 wherein the sleeve body is cylindrical.

3. A blind feeder sleeve according to claim 1 wherein the sleeve body is conical.

4. A blind feeder sleeve according to any of claims 1 to 3 wherein the rib is formed integrally with the inner surface of the sleeve body at each end of the rib.

5. A blind feeder sleeve according to claim 1 wherein the sleeve body is of circular cross-section.

6. A blind feeder sleeve according to claim 1 wherein the sleeve body has an oval horizontal cross-section.

7. A blind feeder sleeve according to claim 5 wherein the rib extends across a diameter of the sleeve.

8. A blind feeder sleeve according to claim 1 wherein the cover is flat.

9. A blind feeder sleeve according to claim 1 wherein the cover is domed.

10. A blind feeder sleeve according to claim 1 wherein the sleeve and gas-permeable core are formed from heat-insulating, exothermic or heat-insulating and exothermic material.

11. A blind feeder sleeve according to claim 1 further comprising means defining a ventilation opening in said cover.

12. A blind feeder sleeve according to claim 4 further comprising means defining a ventilation opening in said cover.

13. A blind feeder sleeve according to claim 5 wherein the rib is formed integrally with the inner surface of the sleeve body at each end of the rib.

14. A blind feeder sleeve comprising: a sleeve body; a cover having a gas-permeable core, the core being formed integrally with the cover of the feeder sleeve; said body having a circular cross-section; and said gas-permeable core consisting of a rib extending directly across the diameter of said sleeve and the inner surface of the cover, and projecting downwardly from that surface in a wedge-like shape.

15. A blind feeder sleeve as recited in claim 14 wherein said rib is formed integrally with the inner surface of said sleeve body at each end of said rib.

16. A blind feeder sleeve as recited in claim 15 wherein the sleeve and gas-permeable core are formed from a material selected from the group consisting essentially of heat-insulating, exothermic, and heat-insulating and exothermic materials.

* * * * *